US010702033B1

(12) United States Patent
Smith

(10) Patent No.: US 10,702,033 B1
(45) Date of Patent: Jul. 7, 2020

(54) CARRYING CASE WITH ADJUSTABLE VIEWING STAND

(71) Applicant: R.D.S. INDUSTRIES, INC., Torrance, CA (US)

(72) Inventor: Richard D. Smith, Fountain Hills, AZ (US)

(73) Assignee: R.D.S. INDUSTRIES, INC., Torrance, CA (US)

( * ) Notice: Subject to any disclaimer, the term of this patent is extended or adjusted under 35 U.S.C. 154(b) by 0 days.

(21) Appl. No.: 16/431,659

(22) Filed: Jun. 4, 2019

Related U.S. Application Data

(60) Provisional application No. 62/785,609, filed on Dec. 27, 2018.

(51) Int. Cl.
*A45C 11/00* (2006.01)
*A45C 13/02* (2006.01)
*A45C 13/10* (2006.01)

(52) U.S. Cl.
CPC ..... *A45C 13/02* (2013.01); *A45C 13/103* (2013.01); *A45C 2011/003* (2013.01); *A45C 2200/15* (2013.01)

(58) Field of Classification Search
CPC ..... A45C 2011/002; A45C 2011/003; A45C 2200/15; G06F 1/166
See application file for complete search history.

(56) References Cited

U.S. PATENT DOCUMENTS 5,927,673 A 7/1999 Kurokawa et al.
6,967,836 B2 11/2005 Huang et al.
7,561,415 B2 7/2009 Liou et al.
8,312,991 B2 11/2012 Diebel et al.
8,328,008 B2 12/2012 Diebel et al.
8,434,601 B2 5/2013 Hou et al.
8,459,453 B2 * 6/2013 Parker ..... F16M 11/10 206/320
8,708,140 B2 4/2014 Liu
8,763,795 B1 7/2014 Oten et al.
8,875,879 B2 11/2014 Diebel et al.
8,887,902 B1 11/2014 Liu
8,887,903 B2 11/2014 Diebel et al.
8,925,721 B2 1/2015 Young
8,925,722 B2 1/2015 Poon et al.
(Continued)

FOREIGN PATENT DOCUMENTS

GB 2489190 A 9/2012
GB 2500315 A 9/2013
(Continued)

OTHER PUBLICATIONS 7 in 1 Nintendo Switch Accessories Carrying Storage Travel Bag Adjustable Stand.

(Continued)

*Primary Examiner* — Mollie Impink

(74) *Attorney, Agent, or Firm* — Kleinberg & Lerner, LLP; Marshall A. Lerner

(57) ABSTRACT

A carrying case for a portable electronic device includes an adjustable viewing stand for supporting the electronic device at an angle selected by the user, the adjustable viewing stand comprising at least two panels hingably connected to one another and foldable so as to be able to reside inside the carrying case when the carrying case is closed.

11 Claims, 7 Drawing Sheets

(56) References Cited

U.S. PATENT DOCUMENTS

| | | | | |
|---|---|---|---|---|
| D723,804 | S | 3/2015 | Coleman | |
| D730,912 | S | 6/2015 | Liu | |
| 9,095,194 | B2 | 8/2015 | Hassett | |
| D737,827 | S | 9/2015 | Tseng | |
| D739,142 | S | 9/2015 | Coleman | |
| D741,867 | S | 10/2015 | Liu | |
| D750,085 | S | 2/2016 | Hsu et al. | |
| 9,268,363 | B2 * | 2/2016 | Green | G06F 1/1626 |
| D750,634 | S | 3/2016 | Langheim | |
| D753,125 | S | 4/2016 | Hsu et al. | |
| 9,382,033 | B2 | 7/2016 | Poon et al. | |
| 9,400,520 | B2 | 7/2016 | Igarashi | |
| 9,417,662 | B1 | 8/2016 | Feng | |
| 9,490,859 | B2 | 11/2016 | Peel | |
| 9,591,905 | B2 | 3/2017 | Poon et al. | |
| 9,603,425 | B2 | 3/2017 | Diebel et al. | |
| 9,661,906 | B2 | 5/2017 | Diebel et al. | |
| D797,108 | S | 9/2017 | Liu | |
| 9,813,533 | B1 | 11/2017 | Ye | |
| 9,826,075 | B2 | 11/2017 | Langhein | |
| D808,168 | S | 1/2018 | Turczynskyj | |
| 9,948,120 | B2 * | 4/2018 | Chan | H01M 2/0285 |
| D822,996 | S | 7/2018 | Ehara et al. | |
| 10,085,531 | B2 | 10/2018 | Diebel et al. | |
| 10,206,471 | B2 | 2/2019 | Hemesath | |
| D845,307 | S | 4/2019 | Hallar et al. | |
| 2004/0134813 | A1 * | 7/2004 | Domotor | A45C 3/02 206/320 |
| 2005/0231930 | A1 | 10/2005 | Jao | |
| 2011/0266194 | A1 | 11/2011 | Bau | |
| 2012/0153116 | A1 | 6/2012 | Harrison | |
| 2013/0233731 | A1 * | 9/2013 | Hsu | A45C 11/00 206/45.23 |
| 2013/0277271 | A1 * | 10/2013 | Toulotte | A45C 11/00 206/752 |
| 2014/0291174 | A1 | 10/2014 | Chung | |
| 2014/0291175 | A1 | 10/2014 | Chung et al. | |
| 2015/0115125 | A1 | 4/2015 | Hou et al. | |
| 2016/0045003 | A1 | 2/2016 | Chen | |
| 2018/0352925 | A1 | 12/2018 | Hemesath | |
| 2018/0375980 | A1 | 12/2018 | Renfrow et al. | |
| 2020/0037716 | A1 * | 2/2020 | Lim | A45C 11/00 |

FOREIGN PATENT DOCUMENTS

| | | | | |
|---|---|---|---|---|
| KR | 20030004385 | A | 1/2003 | |
| KR | 100831137 | | 5/2008 | |
| KR | 10-1944484 | | 1/2019 | |
| KR | 1019444840000 | B1 | 1/2019 | |
| WO | WO-02070373 | A1 | 9/2002 | |
| WO | WO-2013154298 | A1 * | 10/2013 | A45C 11/00 |
| WO | WO-2014008883 | A1 | 1/2014 | |
| WO | WO-2016021946 | A2 | 2/2016 | |
| WO | WO-2016092012 | A1 * | 6/2016 | G06F 1/1626 |
| WO | WO-2018187847 | A1 | 10/2018 | |

OTHER PUBLICATIONS

Nintendo Switch Carrying Case and Stand 2 in 1, Hard Carrying Protective Shell Pouch with 20 Game Cartridges, Compact Adjustable Switch Playstand, Foldable Bracket Holder Dock.
Smatree Carrying Case Stand for Nintendo Switch.

* cited by examiner

CARRYING CASE WITH ADJUSTABLE VIEWING STAND

BACKGROUND OF THE INVENTION

1. Field of the Invention

The present invention relates to a carrying case for a handheld or tabletop electronic device where the carrying case includes an adjustable stand that can support an electronic device and the electronic device typically has a viewing screen.

2. Description of the Related Art

The related art may include covers and cases for electronic devices where the cover or case includes means for selecting and controlling the angle at which the electronic device is positioned for viewing while in use. See for example, U.S. Pat. No. 5,927,673 (Kurokawa), U.S. Pat. No. 7,561,415 (Liou), U.S. Pat. No. 8,328,008 (Diebel), U.S. Pat. No. 8,887,903 (Diebel), U.S. Pat. No. 9,661,906 (Diebel), U.S. Pat. No. D737,837 (Tseng), U.S. Pat. No. D741,867 (Liu), and U.S. Pat. No. D750,634 (Langhein). Two panels that form an angle in a carrying case are shown in U.S. Pat. No. D822,996 (Dhara). None of this prior art, however, discloses a clamshell style carrying case that includes an adjustable stand. Dhara discloses a clamshell style carrying case that includes a pair of panels for holding parts and pieces. The Dhara panels, however, are not adjustable and they are not suitable to act as a stand for an electronic device.

SUMMARY OF THE INVENTION

The invention described herein is a carrying case with an adjustable viewing stand. The carrying case is typically a clamshell style case used for carrying an electronic device such as a Nintendo Switch. The adjustable viewing stand ("stand") is located inside the carrying case and operates in connection with the carrying case. The stand has a surface adapted to support the electronic device and the electronic device typically has a viewing screen. The stand allows the angle of this surface to be adjusted with respect to the carrying case. In this manner, the stand controls the angle at which the electronic device is supported and viewed. This has several benefits including elimination of glare to enhance the crispness of the viewing screen.

BRIEF DESCRIPTION OF THE DRAWINGS

By way of example only, selected embodiments and aspects of the present invention are described below. Each such description refers to a particular figure ("FIG.") which shows the described matter. All such figures are shown in drawings that accompany this specification. Each such figure includes one or more reference characters that identify one or more part(s), element(s) or component(s) of the invention.

DESCRIPTION OF PREFERRED EMBODIMENT

The invention will now be described with reference to the embodiments shown in FIGS. 1 through 7.

Figure 7:
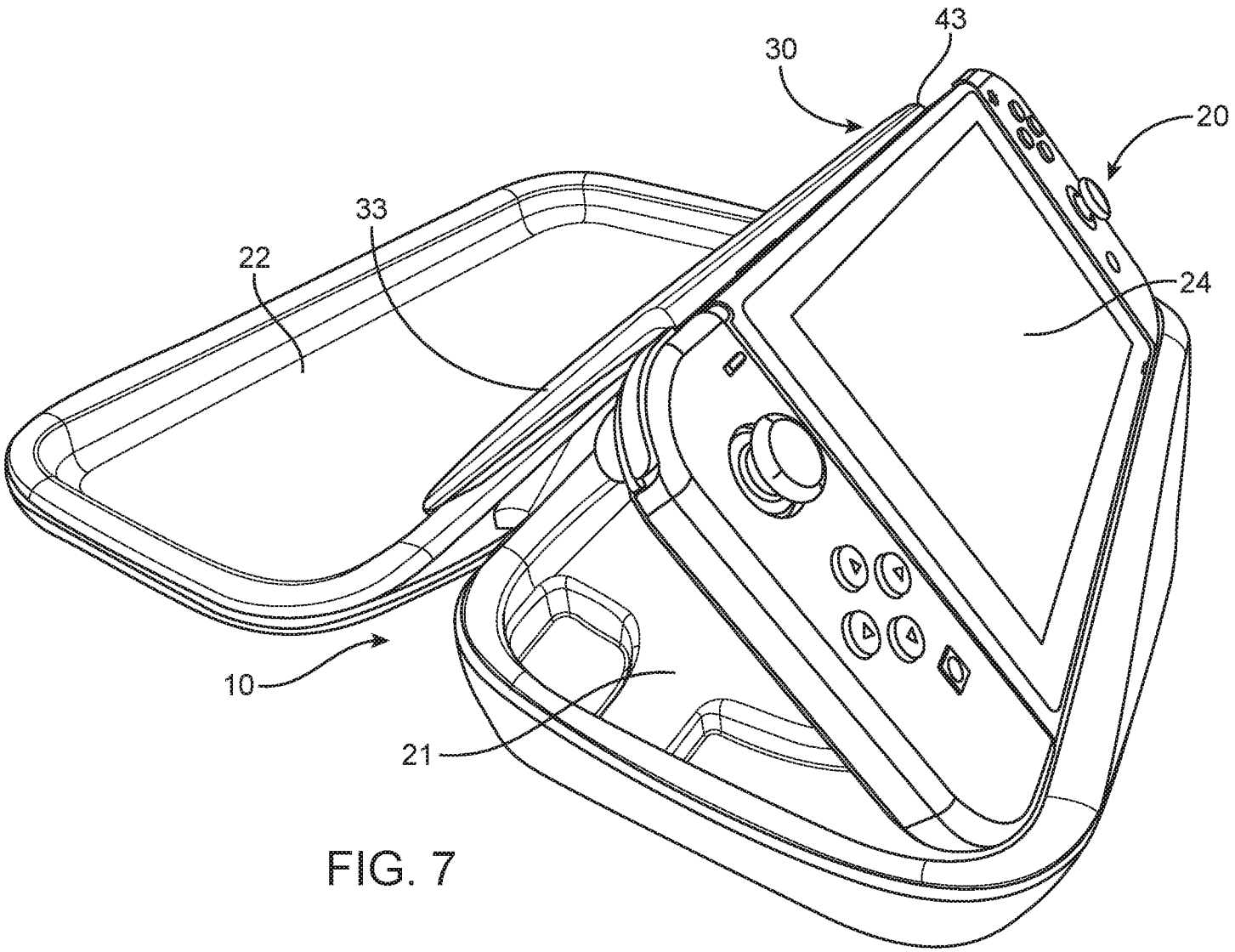
FIG. 7 is a perspective view of FIG. 6 where an electronic device has been placed on the viewing surface of the adjustable viewing stand.

One embodiment of the instant invention, a carrying case 10 with an adjustable viewing stand 30, is shown in FIG. 7. The carrying case 10 typically carries an electronic device 20 that has a viewing screen 24, an example of which is shown in FIG. 7. The back side of the electronic device 20 cannot be seen in FIG. 7, but the viewing stand 30 has a viewing surface 35 (shown in FIG. 4) which is in contact with the back side of the electronic device 20 and supports the electronic device 20.

Figure 1:
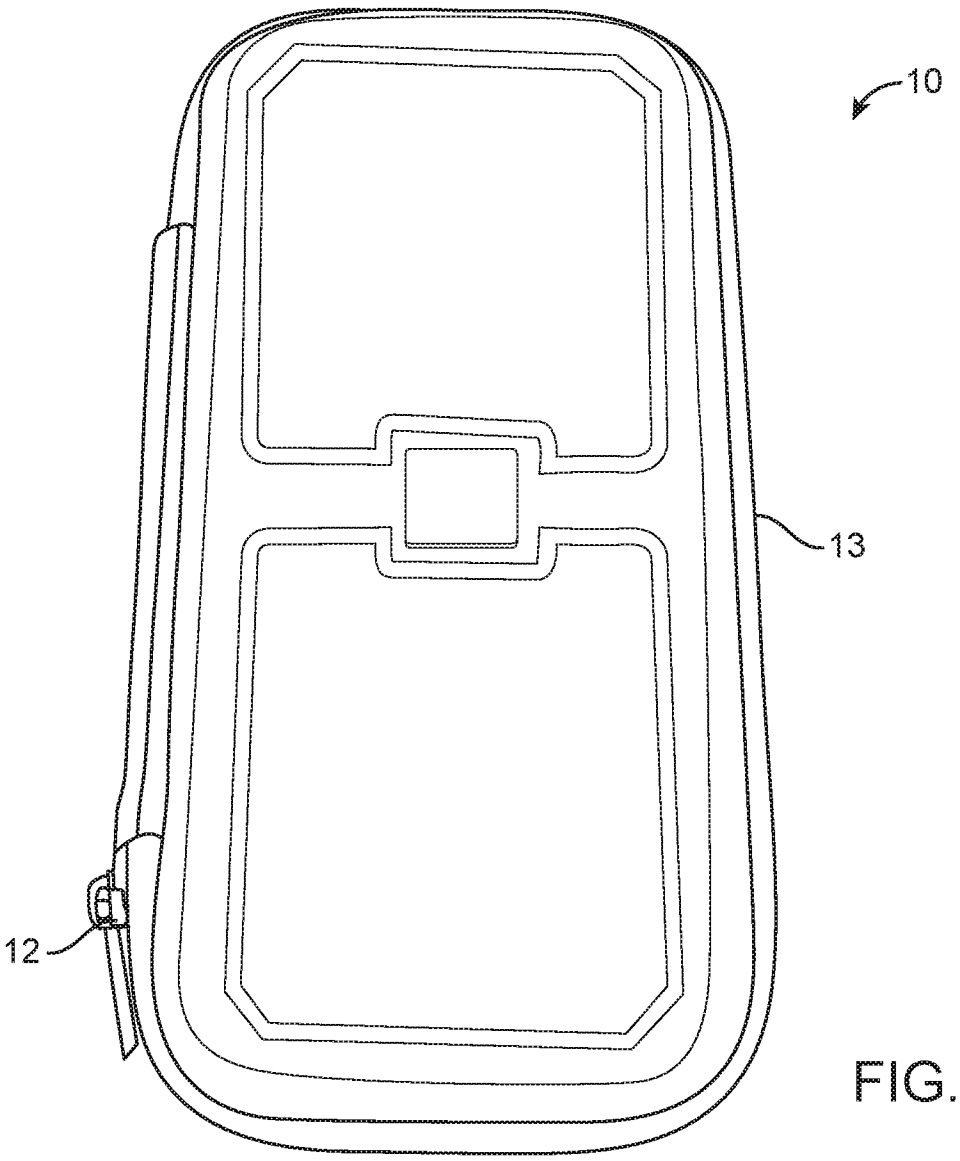
FIG. 1 shows a clamshell style carrying case for an electronic device where the case is closed.
Figure 5:
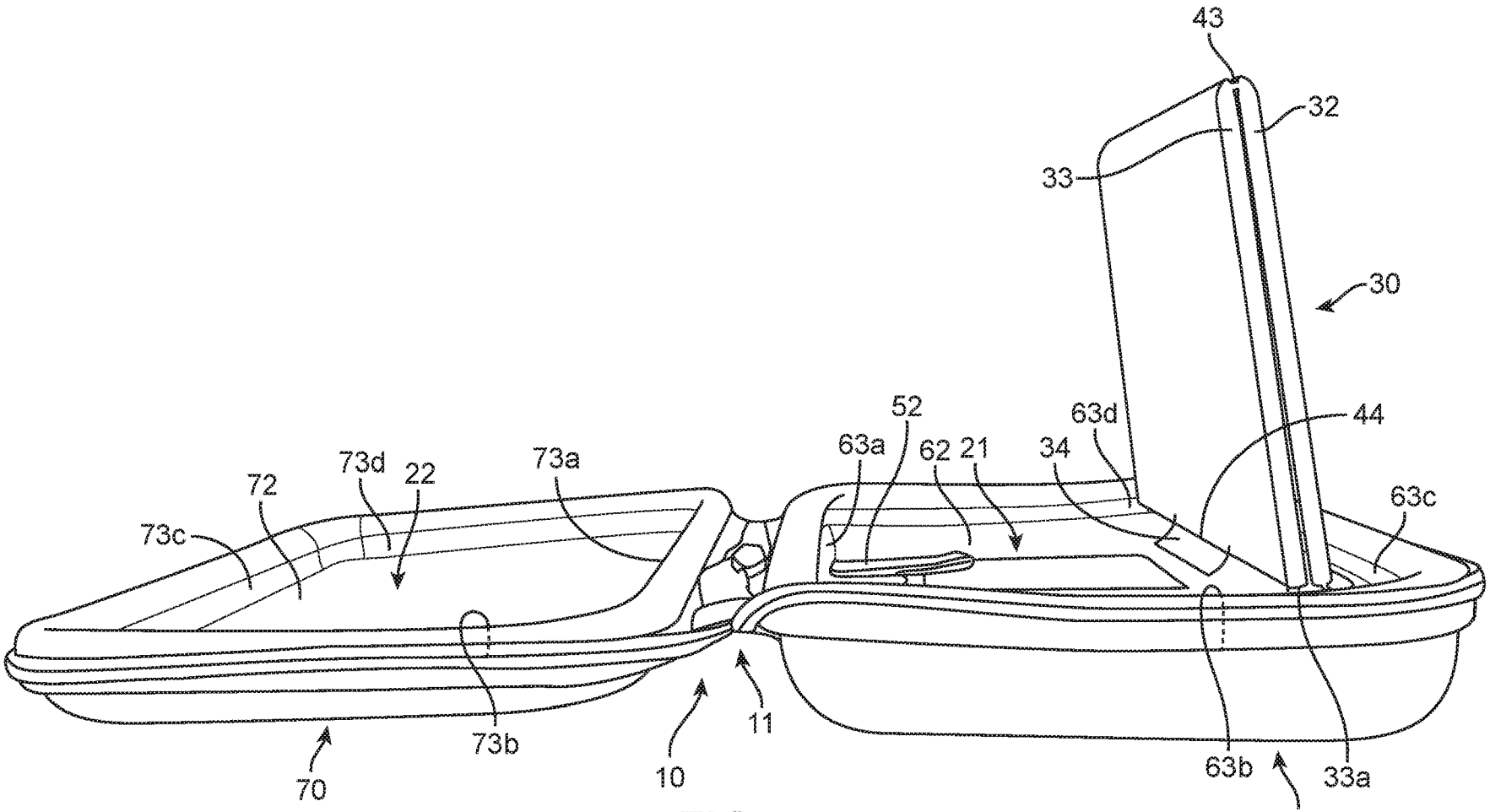
FIG. 5 shows a side view of the case and adjustable viewing stand of FIG. 3 where two panels of the stand are folded against one another and have been rotated away from the case.
Figure 6:
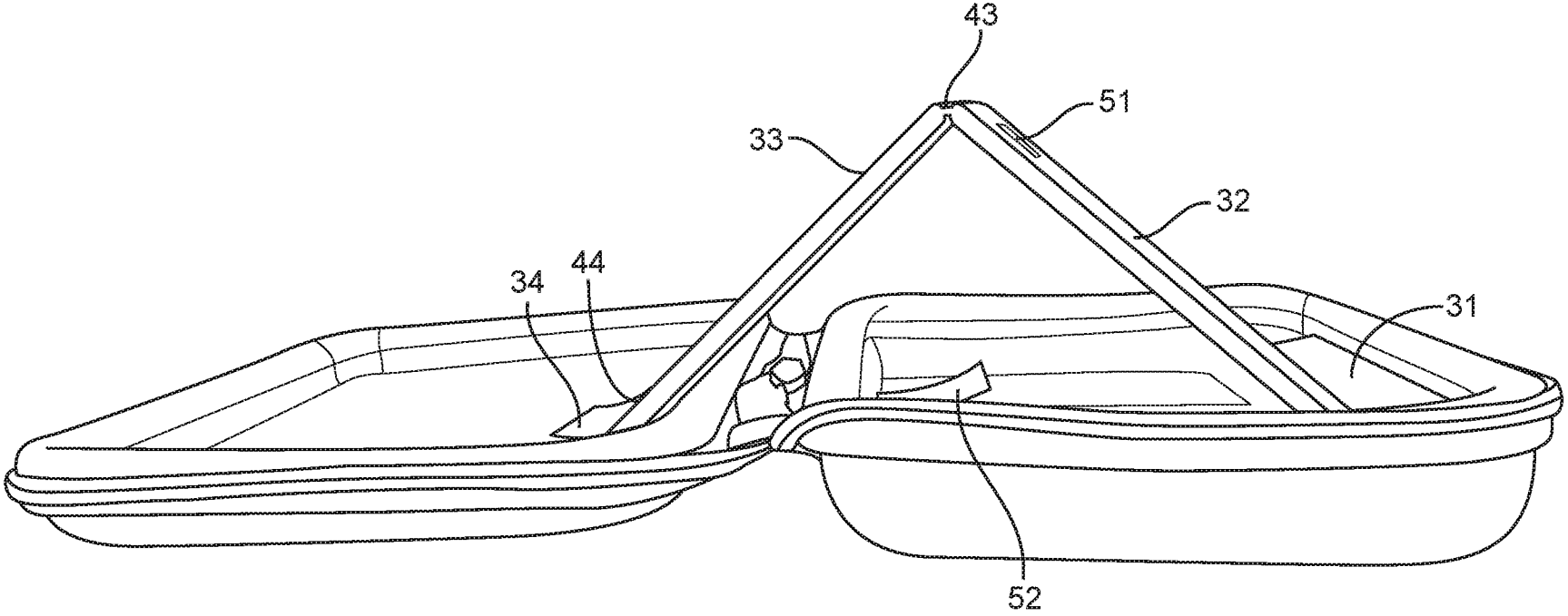
FIG. 6 shows the case and adjustable viewing stand of FIG. 5 where two panels of the stand have been partially unfolded and the stand extends from a first well of the case to a second well of the case.

As seen in FIG. 5, one embodiment of a carrying case 10 has an overall configuration of a bottom portion 60 and a top portion 70 connected to one another by a case hinge 11. As seen in FIG. 1, a zipper 12 runs around the perimeter 13 of this carrying case 10 and is used to keep the carrying case 10 closed. The bottom portion 60 of this carrying case 10 has a first well 21 formed by a first inner surface 62 of the bottom portion 60 where the first inner surface 62 is connected to first walls 63*a*, 63*b*, 63*c*, and 63*d* that form a perimeter around the first inner surface 62. Also in this embodiment which is shown in FIG. 5, the top portion 70 of this carrying case 10 has a second well 22 formed by a second inner surface 72 of the top portion 70 where the second inner surface 72 is connected to second walls 73*a*, 73*b*, 73*c*, and 73*d* that form a perimeter around the second inner surface 72. In an alternative embodiment, the first well 21 and/or the second well 22 are eliminated.

Figure 4:
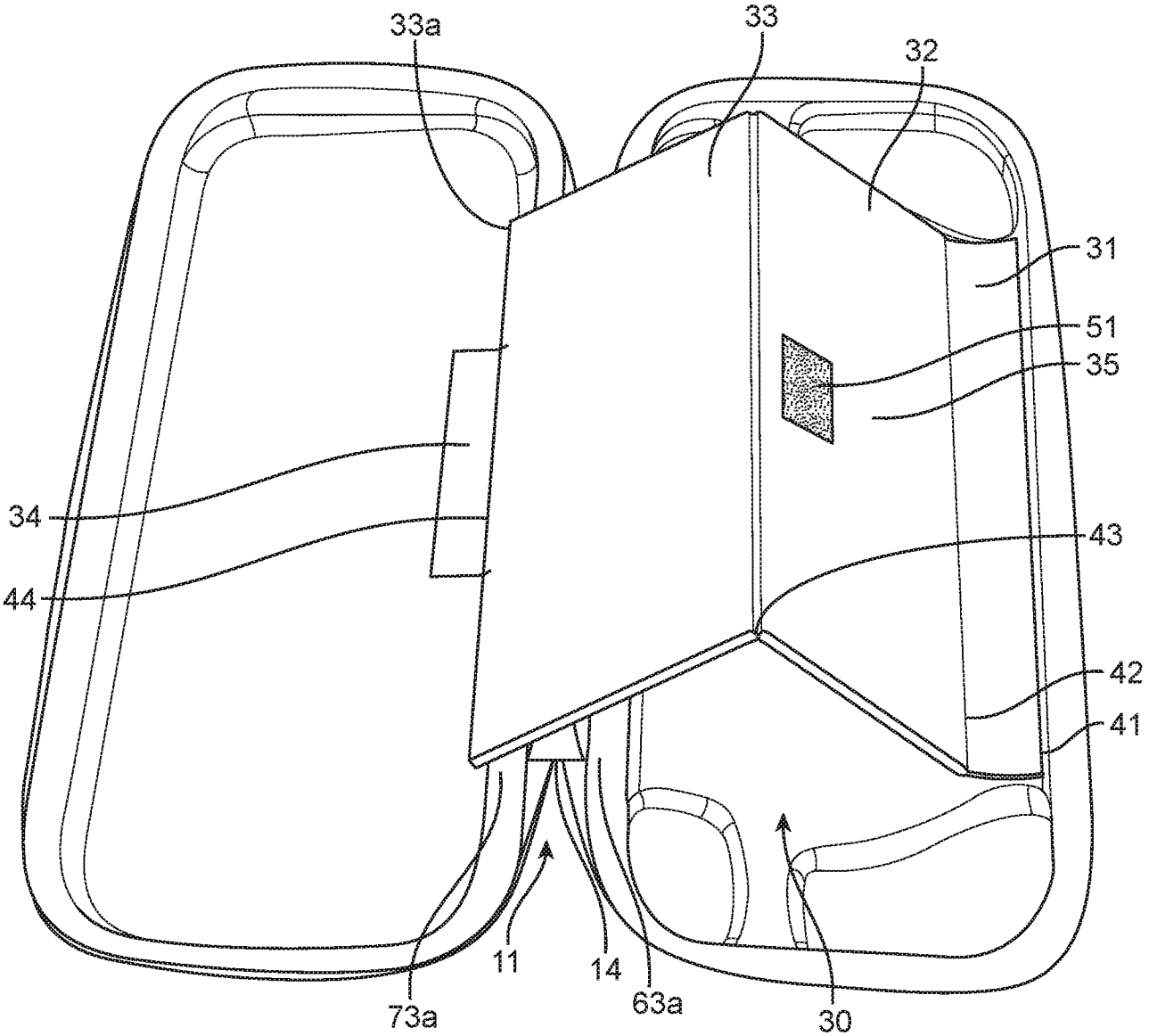
FIG. 4 shows the case and adjustable viewing stand of FIG. 3 where the adjustable viewing stand is partially unfolded and extends from a first well of the carrying case into a second well of the carrying case.

The case hinge 11 may be formed by a strip of material 14 attached to the first wall 63*a* and the second wall 73*a* as shown in FIG. 4. Alternatively, the case hinge 11 may be formed by attaching the first wall 63*a* to second wall 73*a*. This attachment of the first wall 63*a* to the second wall 73*a* can be by, for example, zipper, stitching or hook and loop.

In one embodiment, the adjustable viewing stand 30 comprises a first panel 31, one end of which is fixedly and hingably attached to a first well 21 of the carrying case 10 via a first hinge 41, the opposing end of the first panel 31 is fixedly and hingably attached to one end of a second panel 32 via a second hinge 42. The opposing end of the second panel 32 is fixedly and hingably attached to one end of a third panel 33 via a third hinge 43. The opposing end of the third panel 33 is fixedly and hingably attached to one end of an adjustment tab 34 via a fourth hinge 44. The adjustment tab 34 can be locked in position in a second well 22 of the carrying case 10 by hook and loop fastener material located on the adjustment tab 34 and on the second inner surface 72 of the second well 22.

In one embodiment, the first panel 31 of the viewing stand 30 is hingably attached to the first well 21 of the carrying case 10 at a location opposite the case hinge 11. In this embodiment, the first panel 31 is attached to the first well 21 by being stitched. In an alternative embodiment, the first panel 31 is removably attached to the first well 21 of the carrying case 10 by hook and loop fasteners (not shown). In another alternative embodiment, the viewing stand 30 is storable in the carrying case 10, but is not attached to the carrying case 10. In another alternative embodiment, the viewing stand 30 is hingably attached to first wall 63*c* in lieu of being hingably attached to the first well 21.

In an alternative embodiment, the first panel 31 is eliminated and the viewing stand 30 is connected to the carrying case 10 by way of hingably attaching the second panel 32 to first wall 63*c*. The adjustment tab 34 may also be eliminated. In this embodiment, hook and loop fasteners are attached on and/or adjacent to the open edge 33*a* of the third panel 33.

Figure 2:
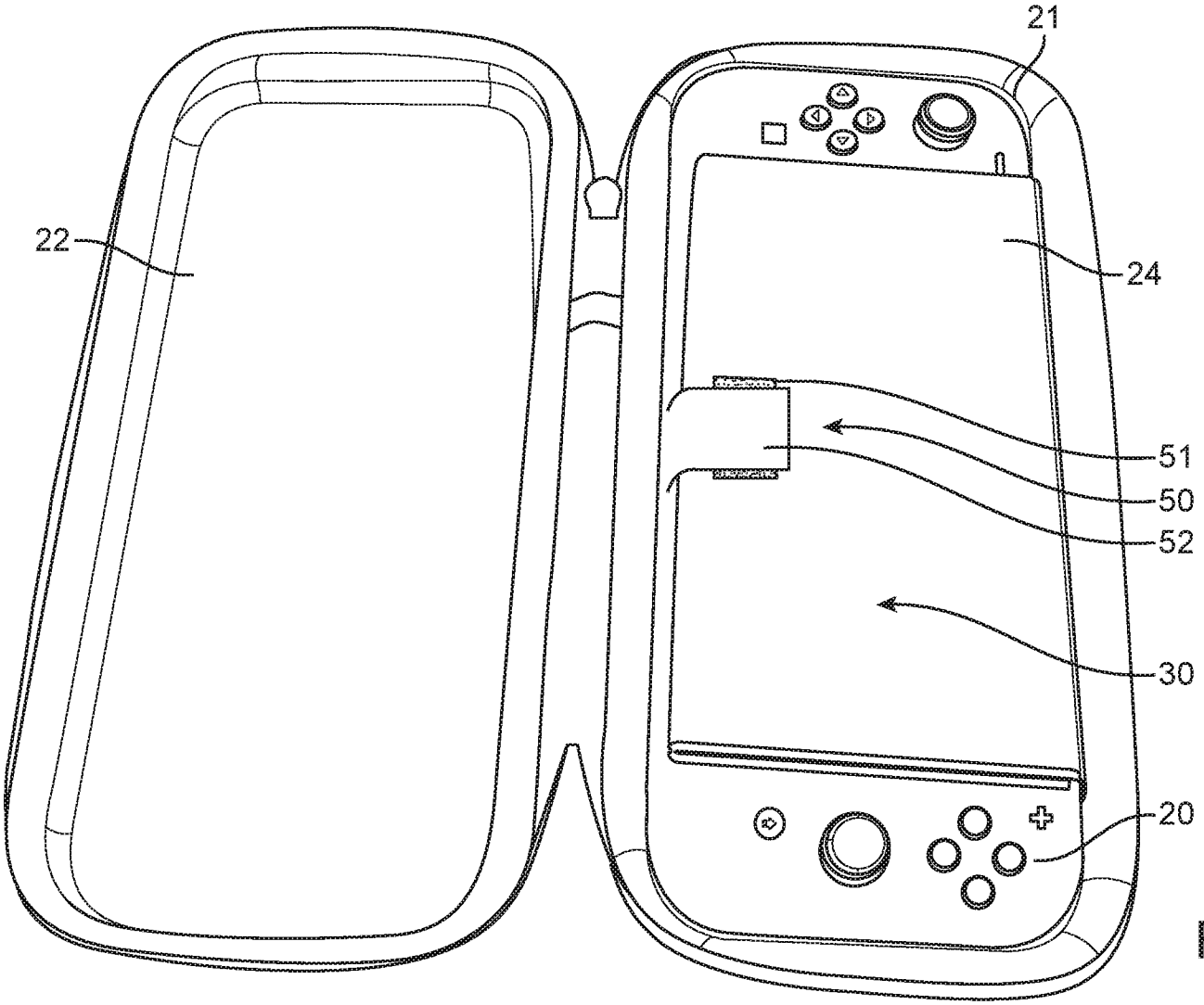
FIG. 2 shows the case of FIG. 1 where the case is open, an adjustable viewing stand is in a folded configuration, and an electronic device is underneath the viewing stand.

As shown in FIGS. 2 and 5, when the electronic device 20 is not in use, it can be stored between the viewing stand 30 and the first inner surface 62 of the bottom portion 60. In an alternative embodiment, the first panel 31 or second panel 32 of the viewing stand 30 is hingably attached to the first inner surface 62 in such a manner that, when not in use, the viewing stand 30 is stored immediately adjacent to the first inner surface 62 and the electronic device 20 is stored on the opposite side of the viewing stand 30.

Figure 3:
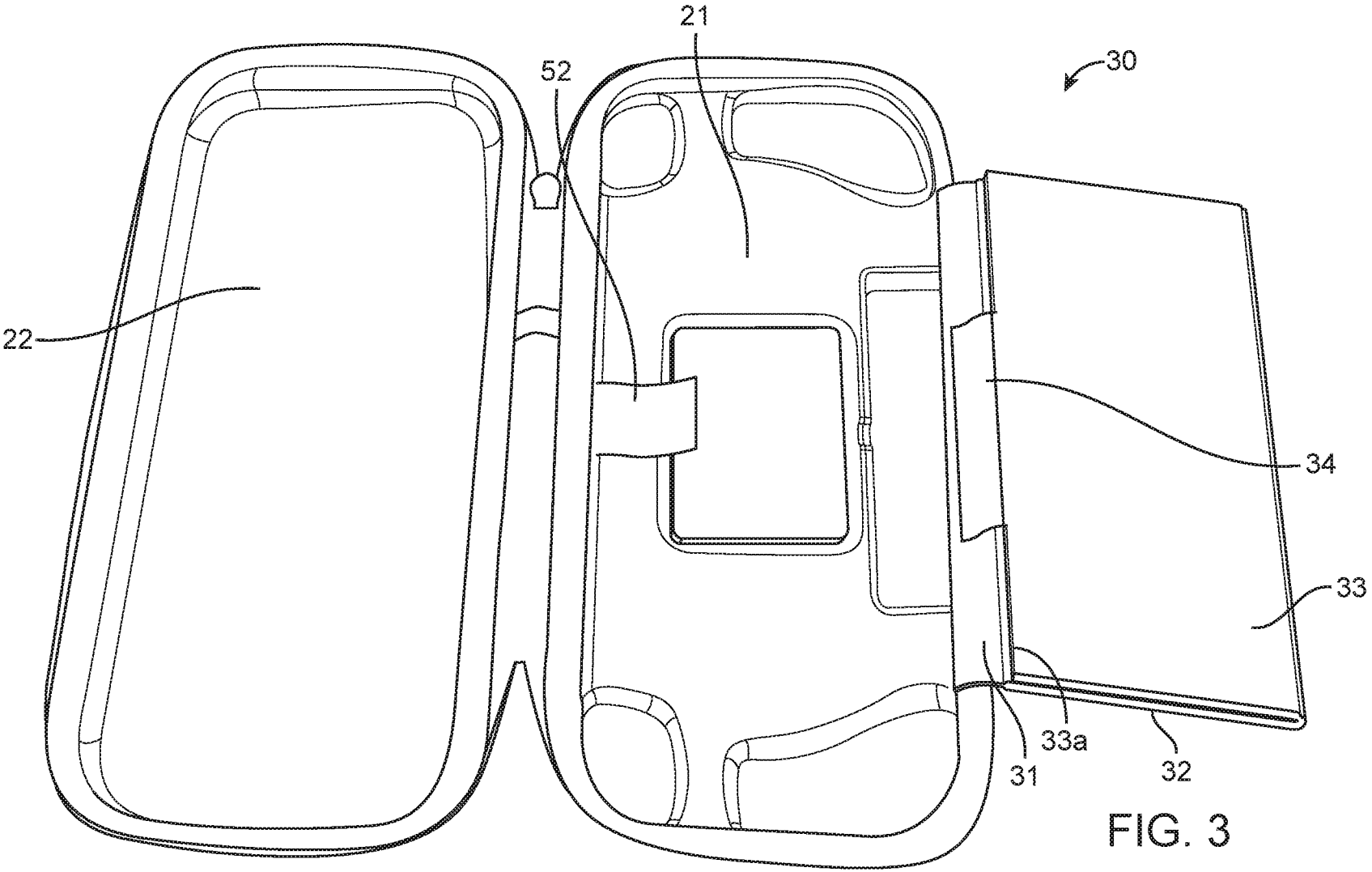
FIG. 3 shows the case of FIG. 1 where the case is open, the adjustable viewing stand is in a folded configuration and has been rotated away from the case, and the electronic device has been removed.

When the stand 30 is not in operation, it can be folded as shown in FIGS. 2, 3 and 5. The width of the first panel 31 may have a width that corresponds to the width of the electronic device 20 to allow the stand 30 to fold over the electronic device. The stand 30 is locked in this position via a closure lock 50. The closure lock 50 comprises a closure pad 51 located on the viewing surface 35 of the stand 30. The closure lock 50 includes a closure tab 52 fixedly connected to a first well 21 of the carrying case 10. As shown in FIG. 2, the closure pad 51 and closure tab 52 each have hook and loop fasteners that fasten to one another by being pressed together by hand or finger. Fastening of the closure pad 51 and closure tab 52 in this manner locks the stand 30 in place around the electronic device 20. The viewing screen of the electronic device 20 is protected when the stand 30 is folded. In this locked position, the carrying case 10 can be closed and transported.

In the operation of the stand 30, the carrying case 10 is opened, is the closure tab 52 is unlocked, and the second panel 32 and third panel 33 remain substantially in contact with one another while they are rotated on second hinge 42 away from the electronic device 20. The electronic device 20 is then removed from the carrying case 10. The second panel 32 and third panel 33 are then unfolded from one another in such a manner and to such a degree that the viewing surface 35 is at the desired angle. The adjustment tab 34 is then locked in place in the second well 22 of the carrying case 10 by pressing its hook and loop fastener against the second inner surface 72 of the second well 22. The electronic device 20 may now be placed on the viewing surface 35. The width of the first panel 31, along with its attachment location in the first well 21, forms a long, narrow trough to hold the electronic device 20 in place while in use and at the same time allows the electronic device 20 to be rotated to different viewing angles if so desired.

In an alternative embodiment, the number of panels in the stand 30 could be two. In another alternative embodiment, the number of panels could be four. In any given embodiment, the stand 30 need not be connected to the carrying case. With respect to the hook and loop fastener in the attachment tab 34 and the second inner surface 72 of the second well 22, any two materials that are resistant to sliding against one another could be used in lieu thereof.

Each panel may be a single sheet or material (such as plastic, cardboard, metal, wood, treated fabric, rubber, resin, polyurethane, a composite or the like) having sufficient rigidity or stiffness to support an electronic device.

The invention may be made using known methods and technologies in the manufacture of carrying cases and viewing stands.

The invention disclosed herein is not limited to the specific embodiments described herein. The disclosed embodiments may be modified or have elements deleted or added while still remaining within the scope of this invention. The invention is described herein by way of example only and is not limited to the disclosed example(s) or embodiment(s). Similarly, the figures are provided as examples of the invention and to aid in understanding the invention and not to act as a limitation on the scope of the invention. Each limitation is expressly defined as not being limited to what is shown in the figures. The embodiments disclosed herein may be modified by those skilled in the art without departing from the scope of the invention.

While the foregoing detailed description sets forth a number of embodiments of a carrying case with adjustable viewing stand in accordance with the present invention, the above description is illustrative only and not limiting of the disclosed invention.

What is claimed is:

1. A carrying case for an electronic device having a viewing screen, the carrying case adapted to be either in a fully enclosed or open state, the carrying case comprising:

a bottom portion and a top portion, the bottom portion having an inner surface, an adjustable viewing stand configurable to support the electronic device, the adjustable viewing stand comprising at least a first panel and a second panel, said first panel and said second panel hingably connected to one another and said first panel connected to the bottom portion, the first panel having a viewing surface that supports a surface of the electronic device opposite the viewing screen, the panels adapted to be foldable so as to fit inside the carrying case when the carrying case is in the fully enclosed state, an adjustment tab connected to the second panel, and the bottom portion providing storage for the electronic device between the viewing stand and the inner surface.

2. The invention of claim 1 wherein the bottom portion has a first well and the top portion has a second well.

3. The invention of claim 2 wherein the carrying case has a case hinge.

4. The invention of claim 2 wherein said first panel is attached to the first well.

5. The invention of claim 2 wherein the bottom portion has a wall and said first panel is attached to the wall.

6. A carrying case for an electronic device having a viewing screen, the carrying case adapted to be either in a fully enclosed or open state, the carrying case comprising:

a bottom portion and a top portion, the bottom portion having an inner surface, a first well and a second well hingably connected to one another, an adjustable viewing stand for the electronic device, the adjustable viewing stand comprising at least a first panel and a second panel, said first panel and said second panel hingably connected to one another and said first panel connected to the bottom portion, the first panel having a viewing surface that, by itself, supports a surface of the electronic device opposite the viewing screen, the panels adapted to be foldable so as to fit inside the carrying case when the carrying case is in the fully enclosed state, an adjustment tab connected to the second panel for locking the second panel in a selected position and the bottom portion providing storage for the electronic device between the viewing stand and the inner surface.

7. The invention of claim 6 wherein said first panel is attached to the first well.

8. The invention of claim 6 wherein the first well has a wall and said first panel is attached to the wall.

9. A carrying case for an electronic device having a viewing screen, the carrying case adapted to be either in a fully enclosed or open state, the carrying case comprising:

a bottom portion and a top portion, the bottom portion having an inner surface, a first well and a second well hingably connected to one another, an adjustable viewing stand configurable to support the electronic device, the adjustable viewing stand comprising at least a first panel and a second panel, said first panel and said second panel hingably connected to one another and said first panel connected to the bottom portion, the first panel having a viewing surface that supports a surface of the electronic device opposite the viewing screen, the panels adapted to be foldable so as to fit inside the carrying case when the carrying case is in the fully enclosed state, means to steadily hold the viewing surface at a position selected by a user, said means comprising an adjustment tab connected to the second panel, said adjustment tab removably lockable in place by hook and loop fastener material, the bottom portion providing storage for the electronic device between the viewing stand and the inner surface, and a storage lock comprising a pad and a tab.

10. The invention of claim 9 wherein said first panel is attached to the first well.

11. The invention of claim 9 wherein the first well has a wall and said first panel is attached to the wall.

* * * * *